US005745024A

United States Patent [19]

Ohta et al.

[11] Patent Number: 5,745,024

[45] Date of Patent: Apr. 28, 1998

[54] FUSE ELEMENT FOR SLOW-BLOW FUSES

[75] Inventors: Manabu Ohta, Ogaki; Akihiko Shimizu, Ibi-gun, both of Japan

[73] Assignee: Pacific Engineering Co., Ltd., Gifu-ken, Japan

[21] Appl. No.: 721,330

[22] Filed: Sep. 26, 1996

[30] Foreign Application Priority Data

Oct. 2, 1995 [JP] Japan ..... 7-279723

[51] Int. Cl.[6] ..... H01H 85/04

[52] U.S. Cl. ..... 337/166; 337/198; 337/255

[58] Field of Search ..... 337/166, 163, 337/160, 152, 198, 255, 268; 439/621, 622; 29/623

[56] References Cited

U.S. PATENT DOCUMENTS

| | | | |
|---|---|---|---|
| 4,646,052 | 2/1987 | Matsunaga | 337/166 |
| 4,751,490 | 6/1988 | Hatagishi | 337/295 |
| 4,944,084 | 7/1990 | Horibe | 29/623 |
| 4,958,426 | 9/1990 | Endo | 29/623 |
| 5,262,751 | 11/1993 | Kudo | 337/296 |
| 5,373,278 | 12/1994 | Saulgeot | 337/255 |
| 5,398,015 | 3/1995 | Kudo | 337/255 |
| 5,488,346 | 1/1996 | Kondo | 337/198 |
| 5,528,213 | 6/1996 | Kondo | 337/160 |
| 5,546,066 | 8/1996 | Kondo | 337/163 |

FOREIGN PATENT DOCUMENTS

| | | |
|---|---|---|
| 59-41563 | 11/1984 | Japan . |
| 61-11258 | 1/1986 | Japan . |
| 7-14494 | 1/1995 | Japan . |
| 7-6686 | 1/1995 | Japan . |

*Primary Examiner*—Leo P. Picard
*Assistant Examiner*—Jayprakash N. Gandhi
*Attorney, Agent, or Firm*—Nixon & Vanderhye

[57] ABSTRACT

For providing a fuse element for slow-blow fuses which uses no separate endothermic member, a fuse element for slow-blow fuses in which wings are formed on both sides of slender element portions connecting top ends of a pair of female terminals by way of narrow and short bridges by punching out of a single electrically conductive sheet.

5 Claims, 9 Drawing Sheets

FUSE ELEMENT FOR SLOW-BLOW FUSES

BACKGROUND OF THE INVENTION

1. Field of the Invention

The present invention relates to a fuse element for slow-blow fuses which are used mainly in vehicles for protecting load circuits from over currents.

2. Description of the Related Art (1) Known as a slow-blow fuse which has a typical fuse element is a slow-blow fuse shown in FIG. 8 wherein a thin sheet-like element 2 is encapsulated, leaving a portion 3 to be fused, and fixed in an endothermic body 15 made of an inorganic material, female terminals 1A and 1B are joined to both ends of the element 2, said endothermic body 15 is accommodated in a space formed in a casing, and the female terminals 1A and 1B are contained in the casing.

This slow-blow fuse was developed by the applicant and is currently used in practice under a license granted as Japanese Utility Model Application No. 1601984 (Utility Model Publication No. 59-41563).

(2) On the other hand, there is known a slow-blow fuse shown in FIGS. 9A and 9B wherein portions to be fused 3 of fuse elements 9 are formed integrally with heat accumulating portions 16 by using an electrically conductive metallic material and electrically conductive ends 17, 17 to be used as connectors for electrically conductive circuits are joined on both sides of the portions to be fused 3.

Speaking concretely of the slow-blow fuse shown in FIG. 9A, it is an example which is obtained by press molding a flat sheet of copper so that a punched flat sheet has projecting heat accumulating portions 16. On the other hand the slow-blow fuse shown in FIG. 9B is obtained by folding back the projecting shown in FIG. 9A so as to form cubic heat accumulating portions 16 as disclosed in embodiments of Japanese Utility Model Publication No. 61-11258.

(3) Further, Japanese Patent Application No. 7-6686 discloses a technology for punching out spring portions 22, which extend from ceiling plates 21 and is not replicated, along a portion to be fused 3 and approximately adjacent thereto for economical use of materials in manufacturing a connecting terminal for fuses of a type obtained by punching and shaping a pair of fuse connecting portions and a portion to be fused out of a single electrically conductive sheet wherein a pair of connecting portions 1A and 1B are configured to sandwich a mating insertion connecting terminal between spring portions 22 and a bottom plate 18 by replicating from a front side spring portions 22 which are surrounded by the bottom plates 18, side plates 19 and 20 continuous thereto on both right and left sides, and ceiling plates 21 are joined to each other by way of the portion to be fused and heat dissipating protrusion portions 26 and 26 are disposed on both the sides of the portion to be fused 3 as shown in FIG. 10: these members are to be punched out of an electrically conductive metal sheet and shaped.

(4) Furthermore, Japanese Patent Application No. 7-14494 discloses a fuse wherein disposed on a metallic fusible member 2 is a wrapping portion 23 so as to wrap a chip 24 made of a metal having a low fusion point, the fusible member is configured to have a narrow portion 25 having a small sectional area and a heat dissipating plate 26 is disposed in the vicinity of the narrow portion 25 as shown in FIG. 11.

The slow-blow fuse mentioned in (1) above in which the element 2 and the endothermic body 15 made of the inorganic material are composed as separate parts requires shaping grooves in the endothermic body and the element since these parts must be precisely coupled and cemented to each other, and a remarkably advanced manufacturing technology since the element 2 and the endothermic body 15 must be assembled with very high mechanical precision. Should the endothermic body be not fixed to the element 2 imperfectly, the slow-blow fuse will not exhibit intended performance.

Accordingly, this slow-blow fuse is expensive from viewpoints of a material cost and a manufacturing cost.

Further, the slow-blow fuse mentioned as (2) above which is punched as an integral member including the heat accumulating portions out of a single flat copper sheet has not yet been put to practical use as far as the inventor knows since the heat accumulating portions 16 are located right close to the portion to be fused, directly project for rather a large width on both the side thereof and exhibit too high a heat accumulating function, thereby disabling the portion to be fused in predetermined conditions or exhibit desired fusing characteristic.

The wrapping type heat accumulating body 16 shown in FIG. 9B is compact but can be manufactured only with a low efficiency since tedious procedures are required for wrapping.

Furthermore, the connecting terminal for fuses mentioned in (3) above in which the heat dissipating protrusion portions 26 are formed on both the sides of the portion to be fused 3 requires tedious procedures for forming the wrapping portion 23 by wrapping the chip 24 made of the metal having a low fusion point on one of the heat dissipating protrusion portions 26 as shown in FIG. 11.

Accordingly, the connecting terminal for fuses mentioned in (3) above is configured to permit manufacturing fuses by economical use of material therefor, whereas the fuse mentioned in (4) above is configured for the purpose of providing fuses which can be fused within a predetermined time when overcurrents are supplied in any of a high region, a middle region or a low region.

SUMMARY OF THE INVENTION

The slow-blow fuse according to the present invention which is free from the problems posed by the various types of conventional fuses described above has been completed, while maintaining the merit of advantageous use of material provided by the terminal for fuses mentioned in (3) above, by examining one by one the many problems described in (2) above and after manufacturing a large number of prototypes or repeating a large number of experiments.

A first fuse element for slow-blow fuses according to the present invention is composed of a single electrically conductive sheet 10 which is punched out so that wings 5 and 5 are formed, by way of narrow and short bridges 4 and 4, on both sides of a middle portion to be fused 3 between element portions 3 connecting upper ends of a pair of female terminals 1A and 1B to each other.

A second fuse element for slow-blow fuses according to the present invention is a first fuse element wherein the narrow and short bridges 4 and 4 which are adjacent to the wings 5 and 5 are connected to the slender element portions 2 within a range of ⅙ to ¼ of a total length of the element portions 2.

A third fuse element for slow-blow fuses according to the present invention is a first or second fuse element wherein the wing 5 disposed by way of the bridge 4 from the slender element portions 2 has a volume of at least 5 $mm^3$ and cubically formed by tight bending.

A fourth fuse element for slow-blow fuses according to the present invention is a first, second or third fuse element wherein the wings 5 and 5 formed on both the sides of the slender element portions 2 are disposed symmetrically with regard to a center of the element portions 2.

The fuse element according to the present invention which is formed as described above absorbs and accumulates heat with the wings at an initial stage where an overcurrent starts flowing, thereby allowing fusion of the portion located in the middle between the element portions and effectively exhibiting a slow-blow characteristic thereof.

The slow-blow characteristic can easily be adjusted by changing the locations of the bridges or a volume of the wings.

Further, the fuse element according to the present invention can be formed simply by punching out and bending a single electrically conductive sheet with a press, thereby making it possible to reduce a material cost, enhance productivity and stabilize a slow-blow characteristic.

Further objects and advantages of the present invention will be apparent from the following description of preferred embodiments of the present invention as illustrated in the accompanying drawings.

Figure 7:
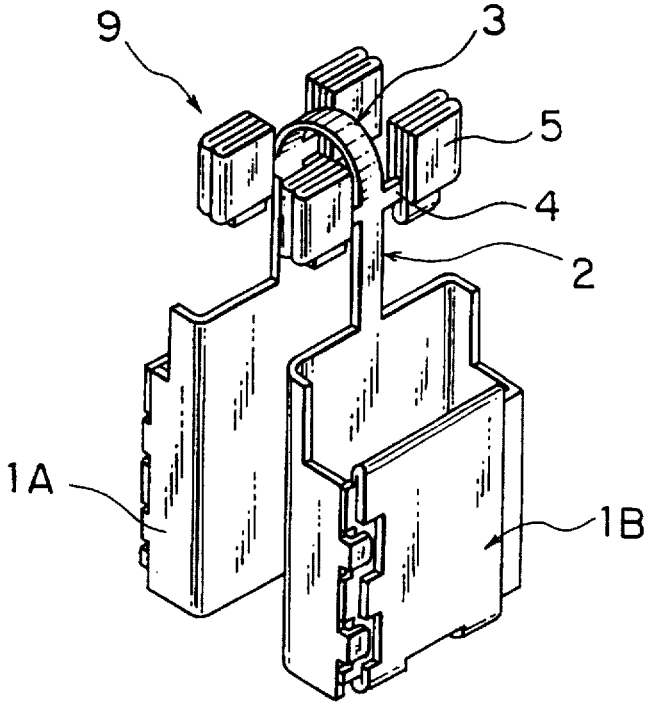
Figure 8:
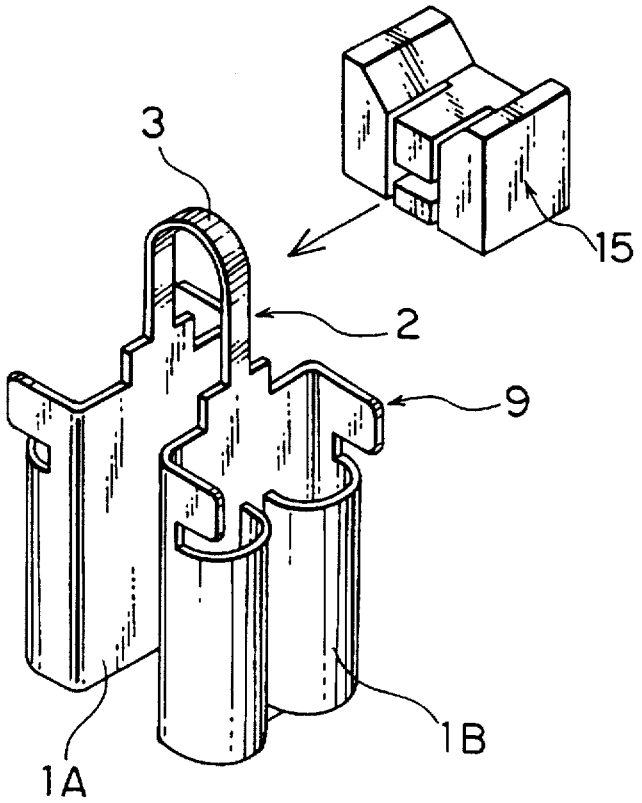
FIG. 8 (Prior Art)
Figure 9A:
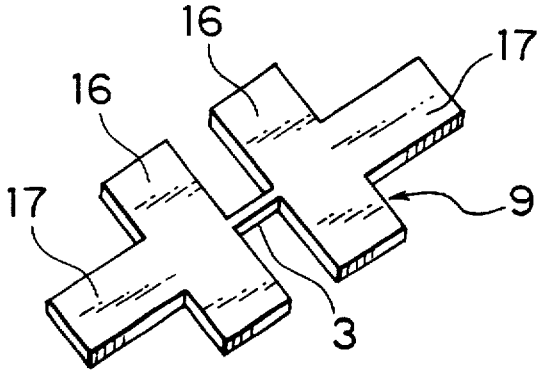
FIG. 9A (Prior Art)
Figure 9B:
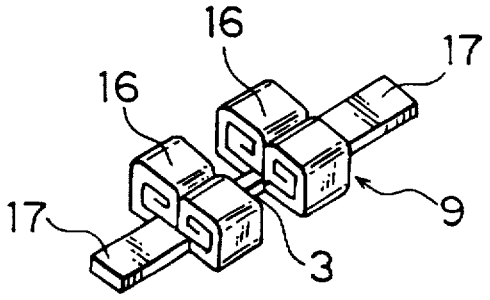
FIG. 9B (Prior Art)
Figure 10:
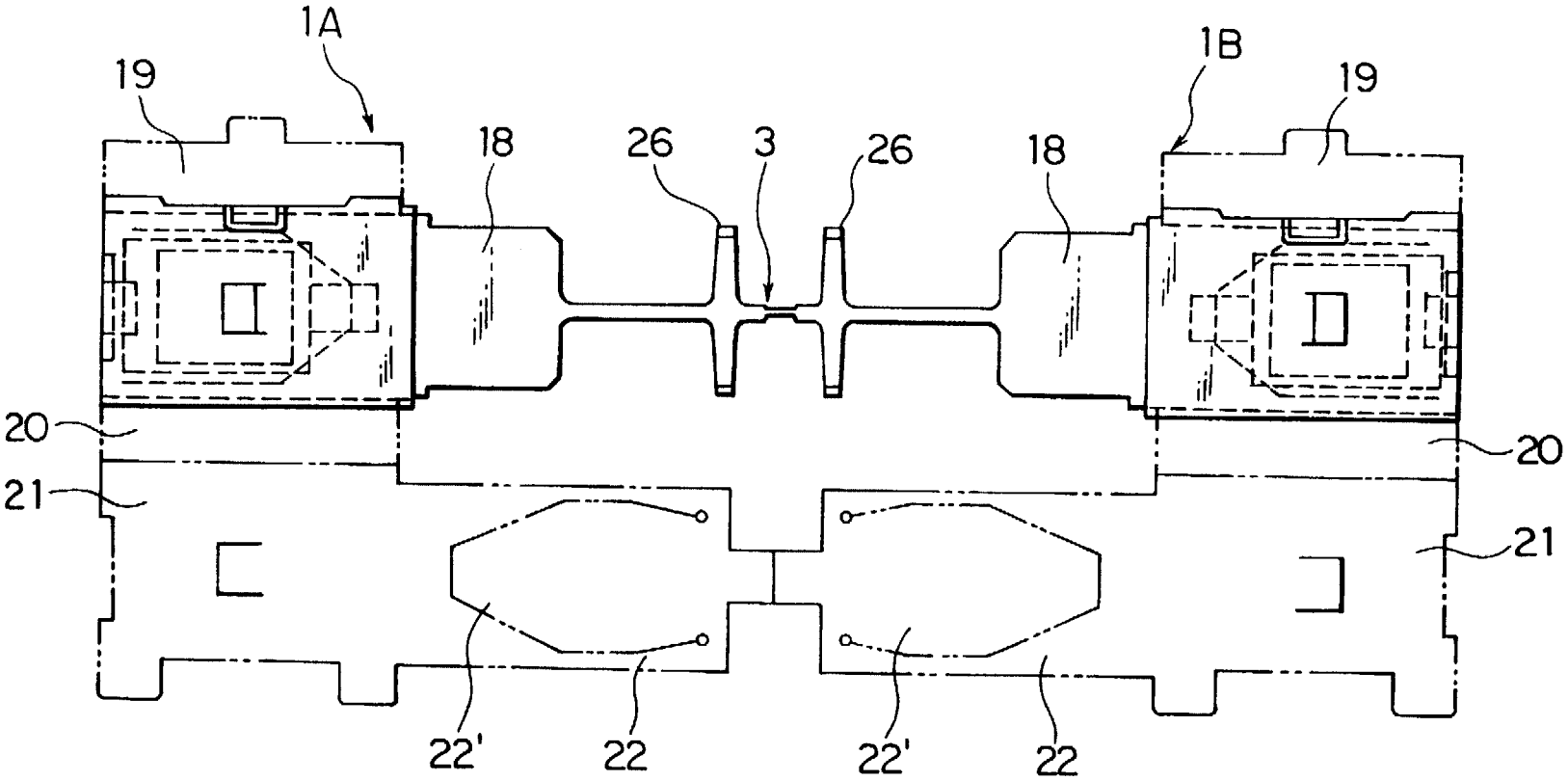
FIG. 10 (Prior Art)
Figure 11:
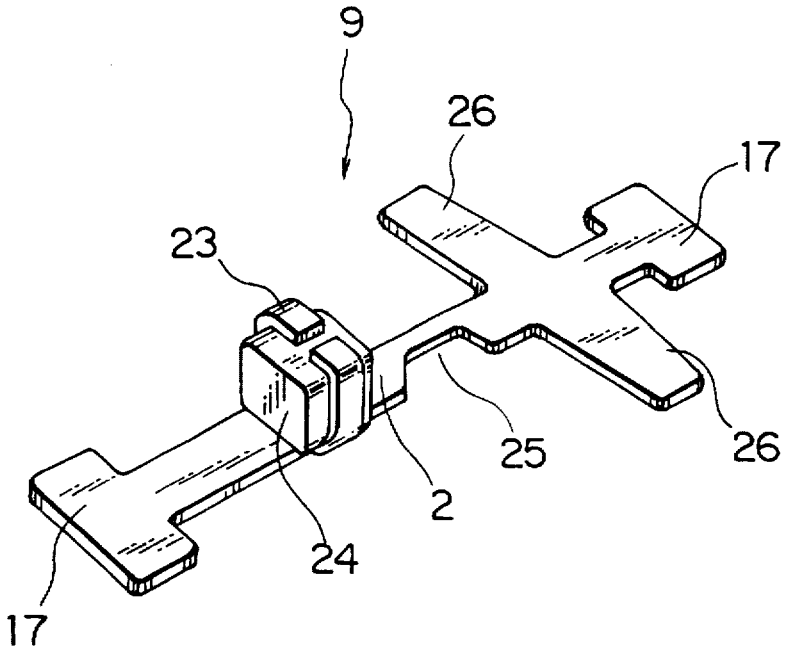
FIG. 11 (Prior Art)

each of FIG. 6A to 6E is a partial plan view illustrating various disposing modes for the bridges and the wings relative to the element portions according to the present invention;

FIG. 7 is a perspective view illustrating another embodiment of the fuse element according to the present invention;

FIG. 8 is a perspective view illustrating a conventional fuse element in a disassembled condition thereof;

each of FIGS. 9A and 9B is a partial perspective view illustrating another conventional fuse element;

FIG. 10 is a development illustrating still another conventional fuse element in a condition before it is formed; and FIG. 11 is a partial perspective view illustrating further another conventional fuse element.

PREFERRED EMBODIMENTS

Now, embodiments of the fuse element for slow-blow fuses according to the present invention will be described with reference to the accompanying drawings.

Figure 1:
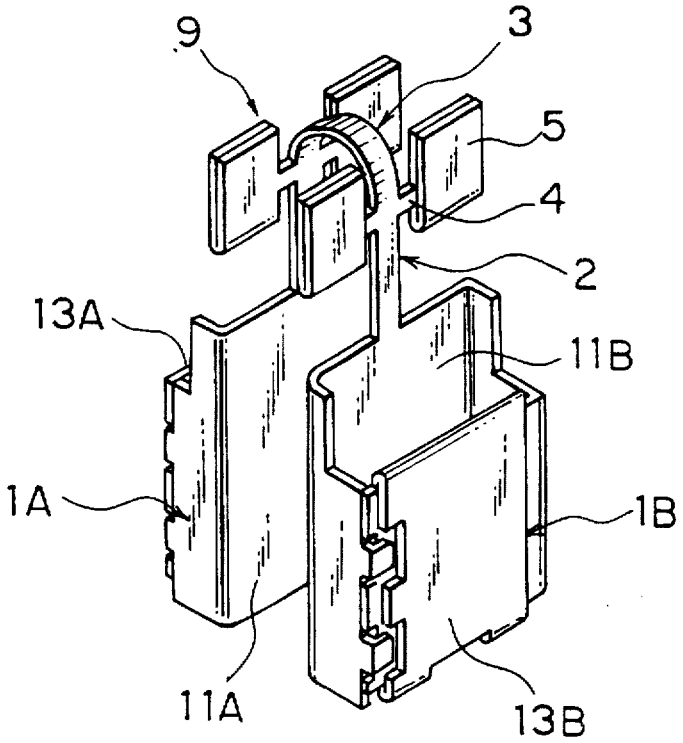
FIG. 1 is a perspective view illustrating an embodiment of the fuse element according to the present invention.

FIG. 1 is a perspective view of the fuse element 9 for slow-blow fuses according to the present invention. This fuse element formed by punching out a single electrically conductive sheet 10 made of a copper alloy of Cu—Fe or Cu—Ni—Si type has inside portions 11A, 11B for composing female terminals 1A, 1B, spring sheets 12A, 12B, outside portions 13A, 13B, slender element portions 2, bridges 4 and wings 5 having an endothermic function which are formed in a condition where they are connected to one another as shown in FIG. 2, by adhesionly bending the wings 5, forming the female terminals 1A, 1B by folding the inside portions 11A, 11B, the spring sheet portions 12A, 12B, the outside portions 13A, 13B and so on into prism-like forms and finally bending the element portions 2.

Figure 2:
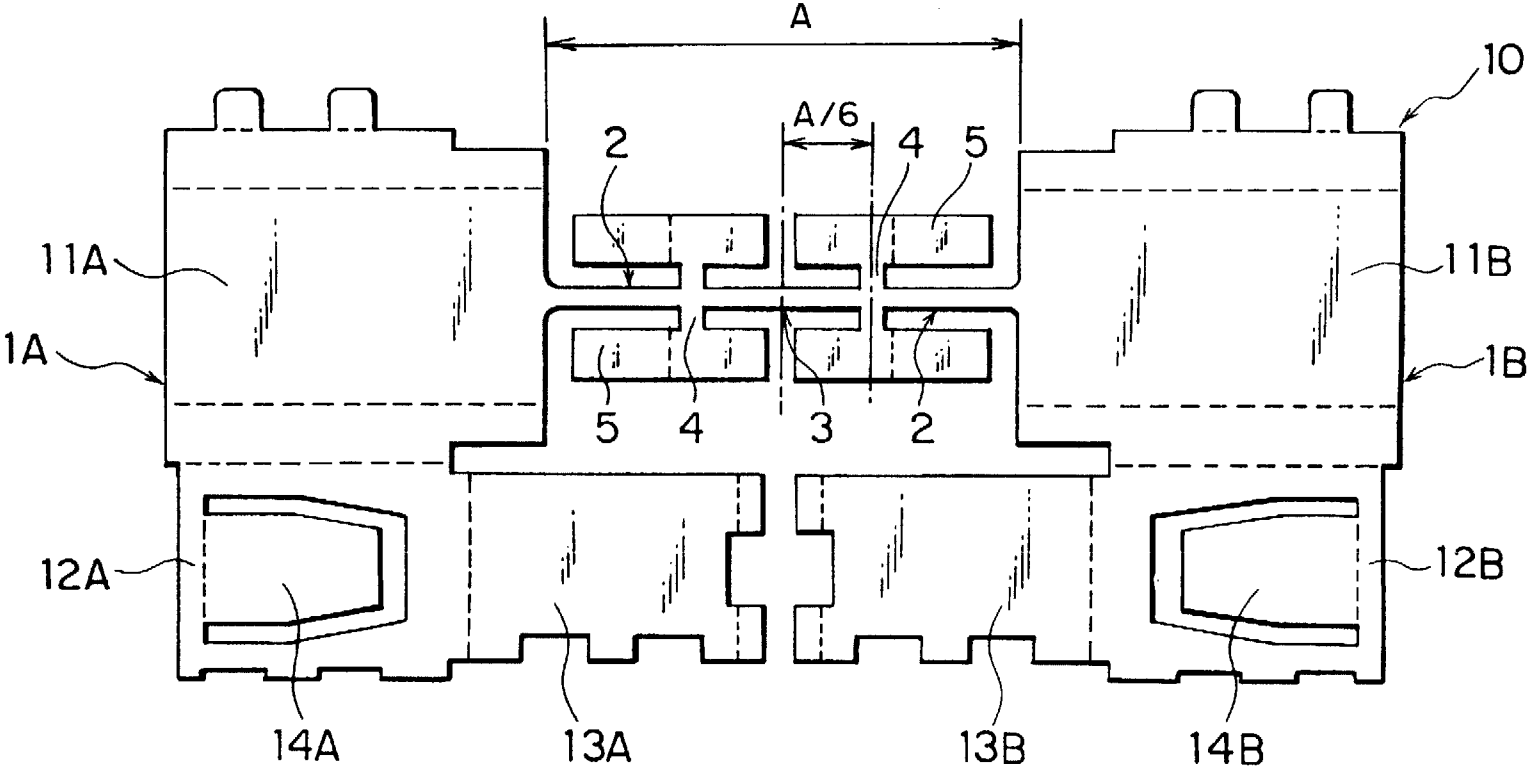
FIG. 2 is a development illustrating the fuse element shown in FIG. 1 in a condition before it is formed.

FIG. 2 shows a development illustrating the fuse element in a condition before it is formed. In this drawing, the reference numerals 11A and 11B represent the inside portions for forming the female terminals on the right and left sides of the element portions 2, the reference numerals 12A and 12B designate the spring sheet portions adjacent downward to the inside portions 11A and 11B, and the reference numerals 13A and 13B denote the outside portions successive inward to the spring sheet portions 12A and 12B.

The spring sheet portions 12A and 12B are formed so as to allow springs 14A and 14B to be cut and raised.

In the drawing, a reference numeral 2 represents slender element portions extending between middles on inside surfaces of the inside portions 11A and 11B and a portion to be fused 3 is formed in a middle thereof, whereas the wide wings 5 and 5 are disposed on both the right and left sides of the portion to be fused 3 by way of narrow bridges 4 and 4.

Figure 3:
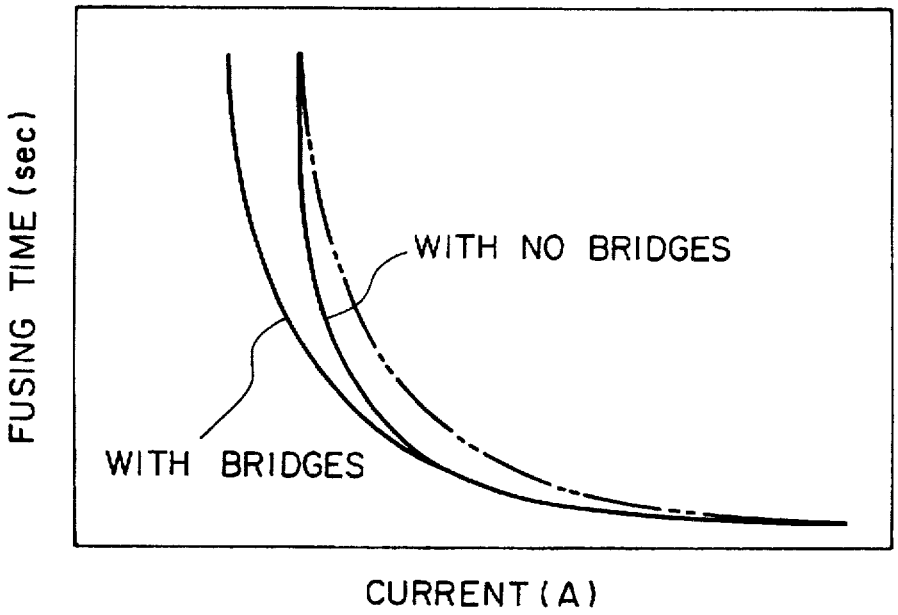
FIG. 3 is a graph illustrating relationship between a current and a fusing time which varies dependently on use of bridges.

These bridges exhibit an effect that: a fuse element which has the bridges 4 is fused in a shorter time than a fuse element which has no bridges as shown in FIG. 3 when they are fused by a relatively low overcurrent though a fusing time remains unchanged at a relatively high overcurrent.

Accordingly, it will be understood that a slow-blow characteristic of the fuse element which has the bridges can be maintained at a higher current level than that of the fuse element which has no bridges and the same capacity as that of the fuse element having the bridges when no-fusing points of the two curves are coincided with each other as indicated by the two-dot chain line. A width and a length of the bridges can be selected adequately dependently on a current region within which the slow-blow characteristic is to be obtained and a desired fusing time.

According to tests effected by the inventor, it is desirable that the bridges have a width and a length which are the substantially the same as a width of the slender element portions 2 or approximately within twice the latter width.

The portions of the fuse element according to the present invention described above are punched out of a single electrically conductive sheet 10 as shown in FIG. 2 by using a press, and then the fuse element shown in FIG. 1 is formed by tightly bending the wings 5 and 5 along the dashed lines shown in FIG. 1, folding the female terminals 1A and 1B along the dashed lines into a prism-like form and finally bending a middle portion between the slender element portions.

Bending times for the wings are not specifically limited but the wings may be bent threefold or fourfold.

A fusing time is delayed or the fuse element is fused more slowly by locating the bridges 4 provided for forming the wings nearer the center of the element portions 2, but locations of the bridges too close to the element portions 2 will pose a problem that the fuse element is not fused at the portion to be fused located at a center between the element portions 2.

Since a fuse generally has a transparent window disposed at a center of a top surface of an insulating housing for permitting visually checking element portions through this transparent window, the visual check is impossible when the fuse element is not fused at the portion to be fused located at the center between the element portions.

In the fuse element for slow-blow fuses according to the present invention, the wide wings 5 and 5 having the heat accumulating function are disposed both the sides of the slender element portions 2 by way of the narrow and short bridges 4 and 4 as the basis, a distance as measured from a center of slender element portion 2 to a center of the bridge 4 is set within the range of ⅙ to ¼ of the total length of the element portion 2 and the wing 5 is configured to have volume of at least 5 $mm^3$ so that the fuse element has a slow-blow characteristic and is to be fused without fail at the center of the element portions 2.

The numerical values set for the fuse element according to the present invention described above are selected for the reasons described below.

Figure 4:
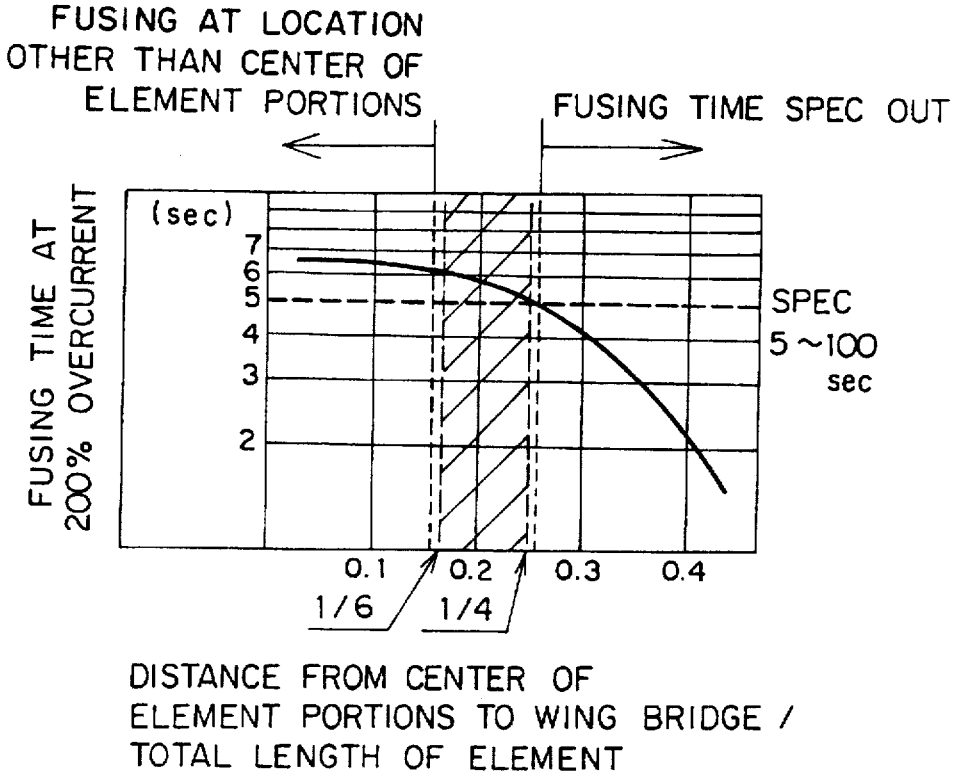
FIG. 4 is a graph illustrating influences on fuse performance due to locations of the bridges.

FIG. 4 is a graph visualizing influences on fuse performance due to locations of the wings 5, or relationship between a fusing time in a 200% overcurrent condition and a ratio of a distance as measured from the center of the element portion to the bridge 4 of the wing 5 relative to a total length of the slender element portion 2.

Since this graph indicates 0.26 as a distance to the bridge 4 for 5 seconds which is the minimum within a range specified for fuses by JASO-D614 (5 to 100 seconds), it is necessary to locate the bridge closer. The present invention selected a ratio not exceeding ¼ (0.25) for affording a slight margin.

As for a shorter distance, it may be selected at any location on the graph. A ratio not lower than ⅙ (0.17) was selected since experimental results indicated rare cases where the fuse element is fused at locations other than the portion to be fused.

Figure 5:
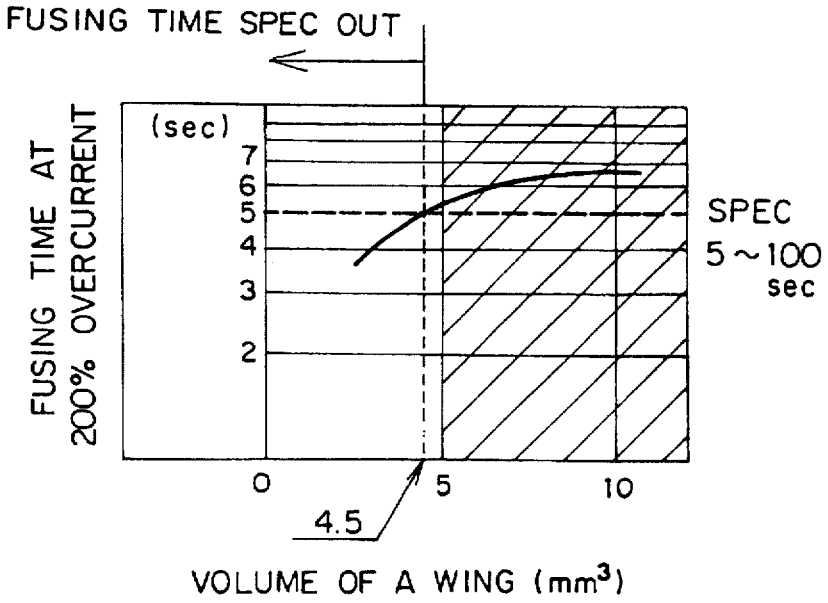
FIG. 5 is a graph illustrating influences on fuse performance due to volumes of wings.

FIG. 5 shows influences on fuse performance due to volumes of the wings, or relationship between a fusing time in the 200% overcurrent condition and a volume of a wing.

Since the graph indicates a volume of 4.5 $mm^3$ of the wing for 5 seconds which is the minimum within the range specified by JASO-D614, the present invention selected a volume not exceeding 5 $mm^3$ for affording a slight margin.

As for an upper limit of the volume of the wing, it is determined of itself practically as approximately 10 $mm^3$ dependently on economical use of the material shown in FIG. 2, balance after bending the spring portions and capacities of fuses.

The data visualized as the graphs shown in FIGS. 4 and 5 described above were obtained by carrying out experiments on fuse elements having a rating of 30A i.e., fuse elements having an electrically conductive sheet 10 which is 0.5 mm thick, element portions 2 which are 0.8 mm wide and have a total length of 40 mm, and bridges 4 which are 1 mm wide and 1 mm long. The conditions described above were specified on the basis of the experimental data obtained with the fuse elements having the rating of 30A since similar data was obtained by measurements effected at intervals of 10 A within a range of ratings from 10 A to 50A.

Since various disposing modes of the wings 5 are conceivable for the fuse element according to the present invention, disposing modes for the bridges 4 and the wings 5 will be described below with reference to the accompanying drawings.

Shown in FIGS. 6A, 6B, 6C, 6D and 6E are various disposing modes for the bridges 4 and the wings 5 relatively to the slender element portions 2. Dashed lines in the drawings indicate locations to be folded and a reference numeral 6 represents slits which are formed on the locations to be folded for facilitating folding and improving tightness of the wings, but not always required.

For the fuse element according to the present invention, it is necessary as described above to dispose the wings 5 symmetrically with regard to the center of the slender element portions 2 (the portion to be fused) in the right-to-left direction for proper heat transmission balance.

Figure 6A:
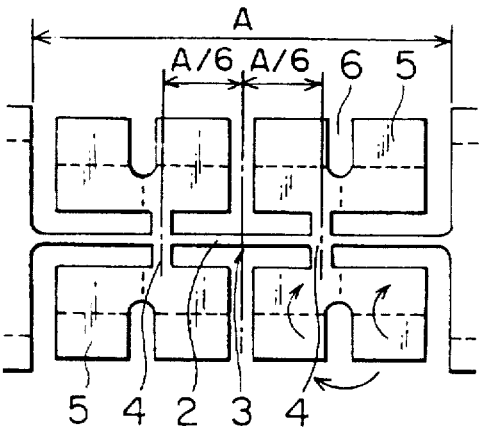
Figure 6B:
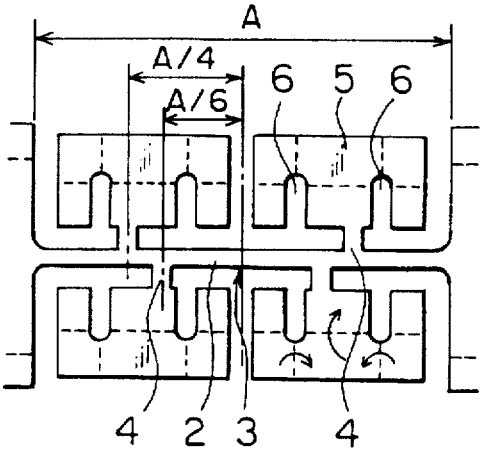
Figure 6C:
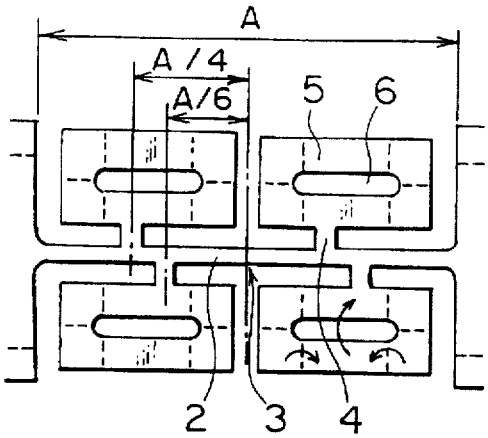
Figure 6D:
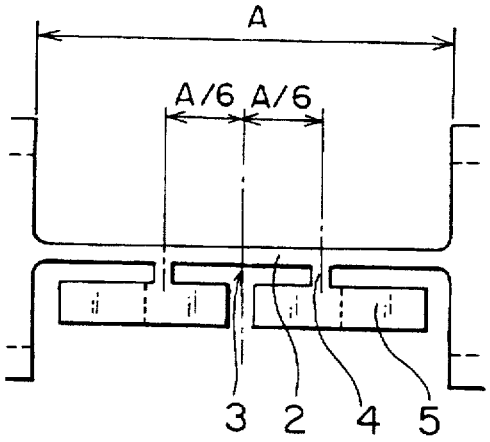
Figure 6E:
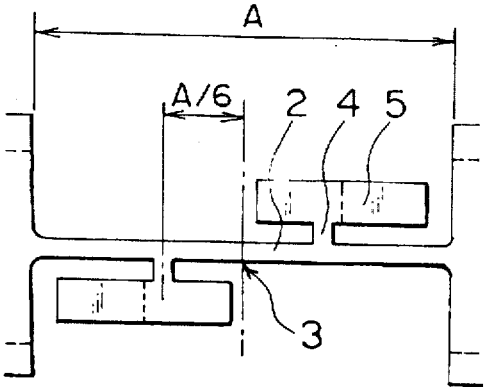

FIG. 7 is a perspective view showing a fuse element which is formed by bending the wings along the dashed lines shown in FIG. 6A.

Many widely different embodiments of the present invention may be constructed without departing from the spirit and scope of the present invention. It should be understood that the present invention is not limited to the specific embodiments described in the specification, except as defined in the appended claims.

What is claimed is:

1. A fuse element for slow-blow fuses, comprising:

a pair of female terminals-, slender element portions with a middle portion to be fused connecting top ends of said pair of female terminals;

narrow and short bridges formed on both sides of said middle portion to be fused; and wings having a heat accumulating function formed by way of said narrow and short bridges;

wherein said pair of female terminals, said slender element portions, said narrow and short bridges and said wings are formed by punching out a single electrically conductive sheet, and said wings are tightly bent after said punching, out.

2. A fuse element for slow-blow fuses according to claim 1 wherein the narrow and short bridges adjacent to the wings are connected to said slender element portions within a distance range from ⅙ to ¼ of a total length of said slender element portions.

3. A fuse element for slow-blow fuses according to claim 1 wherein the wing disposed from the slender element portion by way of the bridge has a volume of at least 5 $mm^3$ and a cubic form obtained by tight bending.

4. A fuse element for slow-blow fuses according to claim 2 wherein the wing disposed from the slender element portion by way of the bridge has a volume of at least 5 $mm^3$ and a cubic form obtained by tight bending.

5. A fuse element for slow-blow fuses according to claim 1 wherein the wings formed on both sides of said middle portion to be fused by way of said narrow and short bridges are disposed symmetrically with regard to a center of said slender element portions.

* * * * *